US009321072B2

(12) United States Patent
Uemura et al.

(10) Patent No.: US 9,321,072 B2
(45) Date of Patent: Apr. 26, 2016

(54) COATING APPARATUS AND INKJET RECORDING APPARATUS

(71) Applicant: FUJIFILM CORPORATION, Tokyo (JP)

(72) Inventors: Hiroshi Uemura, Kanagawa (JP); Naoya Okano, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 85 days.

(21) Appl. No.: 13/929,471

(22) Filed: Jun. 27, 2013

(65) Prior Publication Data

US 2014/0014035 A1 Jan. 16, 2014

(30) Foreign Application Priority Data

Jul. 13, 2012 (JP) ..... 2012-157232

(51) Int. Cl.
*B05C 1/08* (2006.01)
*B41J 2/21* (2006.01)

(52) U.S. Cl.
CPC ..... *B05C 1/0813* (2013.01); *B05C 1/0821* (2013.01); *B05C 1/0834* (2013.01); *B41J 2/2114* (2013.01)

(58) Field of Classification Search
CPC .. B05C 1/0813; B05C 1/0817; B05C 1/0821; B05C 1/0834; B41J 2/2114
USPC ..... 118/243, 256, 259, 261, 266, 46, 300; 347/101, 104, 105
See application file for complete search history.

(56) References Cited

U.S. PATENT DOCUMENTS

| | | | | |
|---|---|---|---|---|
| 4,653,303 | A * | 3/1987 | Richard | 72/236 |
| 4,685,414 | A * | 8/1987 | DiRico | 118/46 |
| 5,221,948 | A * | 6/1993 | Dalal | 399/325 |
| 6,197,113 | B1 * | 3/2001 | Zimmer | 118/249 |
| 8,220,411 | B2 | 7/2012 | Yoshino et al. | |
| 2012/0060754 | A1 | 3/2012 | Kitaoka et al. | |

FOREIGN PATENT DOCUMENTS

| | | | |
|---|---|---|---|
| JP | 2007-296424 | A | 11/2007 |
| JP | 2009-172506 | A | 8/2009 |
| JP | 2012-056261 | A | 3/2012 |

* cited by examiner

*Primary Examiner* — Laura Edwards
(74) *Attorney, Agent, or Firm* — Studebaker & Brackett PC

(57) ABSTRACT

A coating apparatus includes: a coating roller configured to apply coating liquid to a recording medium; a measuring roller configured to intermittently supply the coating liquid to the coating roller by being brought into contact with and being separated from the coating roller; a coating liquid pan configured to stores the coating liquid; and a roller cover configured to cover the measuring roller. When the measuring roller moves between a contact position where the coating roller and the measuring roller come into contact with each other and a separation position where the coating roller and the measuring roller are separated from each other, the measuring roller and the roller cover integrally operate while maintaining their relative positions, in a state where the coating liquid pan is fixed.

15 Claims, 9 Drawing Sheets

COATING APPARATUS AND INKJET RECORDING APPARATUS

BACKGROUND OF THE INVENTION

1. Field of the Invention

The claimed invention relates to a coating apparatus and an inkjet recording apparatus. In particular, the claimed invention relates to a coating apparatus and an inkjet recording apparatus, in which coating liquid is applied by roller coating.

2. Description of the Related Art

In the past, a printing system that performs image formation by ink jetting onto general-purpose paper has been proposed. In such a printing system, treatment liquid that causes an aggregation reaction of ink is applied onto paper in advance prior to inkjet dropping. As means for applying the treatment liquid, a dropping method by an inkjet head or various methods such as a die coater, a slit coater, and a curtain coater which are traditional coating methods have been considered. However, as a method in which a high-quality coated surface is obtained at a relatively low price and stably, a roller coating method is used.

Among them, in an inkjet system which uses a sheet transport drum method, a method is known which performs on-demand coating by having an anilox roller (a measuring roller) contact with and separate from a coating roller for each sheet of paper in order to prevent extra coating liquid from sticking to areas other than the paper.

Here, the anilox roller is immersed in a coating liquid pan and draws up the coating liquid therefrom. Then, a measuring blade scraps away extra coating liquid from the anilox roller, and thereby a certain amount of liquid is supplied to the coating roller. However, in a case where a non-application state (a standby state or the like of a device) lasts for a long time, there is a problem in that a solvent of the coating liquid in the coating liquid pan evaporates due to the circulation of liquid, whereby the coating liquid is concentrated, and thus image quality deteriorates. For this reason, control is required which detects the concentration of the coating liquid and maintains a constant concentration of the coating liquid by supplying diluting liquid in a case of a certain threshold being exceeded. However, in this case, since a concentration meter, a diluting liquid tank, piping for dilution, a pump, a flow path valve, or the like is additionally required. Accordingly, there is also a problem in that the cost of a device increases and labor of a user such as diluting liquid replenishment work or regular cleaning of the concentration meter increases.

In order to solve such problems, for example, in JP2012-56261A, there is described a configuration in which in a coating device using a squeeze roller and a coating roller, the entirety of the squeeze roller and the coating roller is covered by a housing member. Further, in JP2007-296424A, there is described a coating device in which for evaporation prevention, a roller and a base material are covered by a cover and when the roller is retreated at the time of non-coating, the cover is also simultaneously moved. Further, in JP2009-172506A, there is disclosed a coating device configured so that a hermetically-sealed liquid retaining section is brought into contact with a roller.

SUMMARY OF THE INVENTION

However, in a case where a method to cover the entire coating section as described in JP2012-56261A and JP2007-296424A is applied to an on-demand type coating device, it is necessary to integrally operate a section for storing coating liquid (i.e., the coating liquid) for each sheet of paper. Thus, there is a problem in that coating unevenness occurs due to undulation of a liquid surface in the coating liquid, liquid splashing, or unstable supply to a roller.

Further, even if a cover is provided at a measuring roller, it is necessary to provide an opening portion in order to apply the treatment liquid by bringing the measuring roller into contact with a coating roller and separating the measuring roller from the coating roller. Although the cover provided at the measuring roller prevents the treatment liquid from being evaporated, vapor inside the cover is disturbed due to operation of the roller, and thereby conflicting problems arise in that external air flows into the cover and evaporation cannot be prevented.

Further, in JP2009-172506A, a liquid retaining member which supplies treatment liquid is hermetically sealed. However, since it is not possible to prevent evaporation from the exposed surface of the roller, even if only the liquid retaining member is hermetically sealed, the effect is not exhibited.

Further, since the humidity inside the cover becomes high by covering the treatment liquid with the cover, there is also a secondary deleterious effect in which dew condensation occurs inside the cover and liquid droplets are formed, thereby sticking to the anilox roller, whereby unevenness occurs.

The claimed invention has been made in view of such circumstances and has an object to propose a roller cover structure capable of preventing a liquid surface from undulating in a coating liquid pan and effectively preventing evaporation of coating liquid, and thus provide a coating apparatus and an inkjet recording apparatus having a low-cost treatment liquid applying system without the need for a concentration meter or a dilution function required in the related art.

In order to achieve the object, according to an aspect of the invention, there is provided a coating apparatus including: a coating roller configured to apply coating liquid to a recording medium; a measuring roller configured to intermittently supply the coating liquid to the coating roller by being brought into contact with and being separated from the coating roller; a coating liquid pan configured to store the coating liquid; and a roller cover configured to cover the measuring roller, in which, when the measuring roller moves between a contact position where the coating roller and the measuring roller come into contact with each other and a separation position where the coating roller and the measuring roller are separated from each other, the measuring roller and the roller cover integrally operate while maintaining their relative positions, in a state where the coating liquid pan is fixed.

According to the aspect of the invention, the roller cover configured to cover the measuring roller is provided. At the time of a separation operation of the measuring roller from the coating roller, during which separation operation the coating liquid is not applied to the coating roller, the measuring roller and the roller cover are integrally moved while the relative positions of the measuring roller and the roller cover are maintained. Therefore, since the roller cover is provided, it is possible to prevent evaporation of the coating liquid from the surface of the measuring roller, and thereby it is possible to decrease a rate of concentration of the coating liquid. Further, since the presence or absence of supply of the coating liquid to the coating roller can be changed as the coating liquid pan being fixed, it is possible to prevent undulation of the liquid surface and liquid splashing of the coating liquid in the coating liquid pan due to movement of the coating liquid pan. In addition, since the liquid surface of the coating liquid is stabilized, it is possible to perform normal detection of the liquid surface.

Further, since the measuring roller and the roller cover are integrally operated as the relative positions of the measuring roller and the roller cover being maintained, it is possible to maintain constant clearance between the measuring roller and the roller cover at an opening position of the measuring roller to the coating roller. In a case where only the measuring roller is operated to separate from the coating roller, the clearance between the measuring roller and the roller cover becomes wide and vapor inside the roller cover is likely to be replaced with external air due to the movement of the measuring roller, and thereby the coating liquid is likely to evaporate and a concentration of the coating liquid is likely to change. On the other hand, according to the above aspect of the invention, since the clearance is maintained constant, when the measuring roller is operated to separate from the coating roller, it is possible to prevent vapor inside the roller cover from being replaced with external air, and therefore, evaporation of the coating liquid can be prevented.

According to another aspect of the invention, the coating apparatus may further include a measuring blade configured to come into contact with the measuring roller, thereby scraping away extra coating liquid from the coating liquid drawn up by the measuring roller, in which the measuring blade operates integrally with the measuring roller and the roller cover.

According to the aspect of the invention, since the coating apparatus is provided with the measuring blade and the measuring blade is also moved integrally with the measuring roller and the roller cover, even in a case of the measuring blade being provided, it is possible to decreases a rate of concentration of the coating liquid and stabilize the liquid surface of the coating liquid in the coating liquid pan.

According to still another aspect of the invention, the roller cover may cover at least a portion of an area from the measuring blade to a contact point between the coating roller and the measuring roller on a downstream side in a rotation direction of the measuring roller.

With respect to evaporation of the coating liquid, in a case where the coating liquid is scraped away to a predetermined amount by the measuring blade, the amount of coating liquid on the measuring roller becomes small, and thereby a solvent is likely to evaporate. According to the coating apparatus according to the aspect of the invention, since the roller cover covers at least a portion of an area from the downstream side in the rotation direction of the measuring roller of the measuring blade to a contact point between the coating roller and the measuring roller, a position where the coating liquid is likely to evaporate can be covered by the roller cover. Therefore, it is possible to prevent concentration of the coating liquid.

According to still another aspect of the invention, a seal member configured to come into contact with the measuring roller may be provided on up upstream side in the rotation direction of the measuring roller of the coating liquid pan.

According to the coating apparatus related to the aspect of the invention, since the seal member is provided on the upstream side in the rotation direction of the measuring roller of the coating liquid pan so as to come into contact with the measuring roller, it is possible to prevent evaporation of the coating liquid from the coating liquid pan.

According to still another aspect of the invention, the coating liquid pan and the roller cover may be connected by the seal member and the coating liquid pan and the roller cover may be in a connected state when the coating roller and the measuring roller move between a contact position and a separation position.

According to the coating apparatus related to the aspect of the invention, since the coating liquid pan and the roller cover are connected by the seal member, it is possible to make the inside of the roller cover be in a hermetically-sealed state, and thus it is possible to prevent evaporation of the coating liquid.

According to still another aspect of the invention, the measuring blade may also serve as the roller cover.

According to the coating apparatus related to the aspect of the invention, since the measuring blade also serves as the roller cover, the apparatus can be simplified. Further, it is possible to suppress a variation in the contact force of the measuring blade with respect to the measuring roller when operating the measuring roller, the measuring blade, and the roller cover. Therefore, since it is possible to stabilize the amount of treatment liquid which is adjusted by the measuring blade, coating unevenness can be prevented.

According to still another aspect of the invention, the roller cover may have a heat-insulated structure.

According to the coating apparatus related to the aspect of the invention, by making the roller cover have a heat-insulated structure, it is possible to prevent dew condensation of the coating liquid in the roller cover. Therefore, since it is possible to prevent the coating liquid from condensing into dew and sticking to the roller cover and it is possible to prevent dew-condensed liquid from sticking to the measuring roller, coating unevenness can be prevented.

According to still another aspect of the invention, the heat-insulated structure may be provided by carrying out raising treatment on an inner surface of the roller cover.

According to the coating apparatus related to the aspect of the invention, since the raising (i.e., napping) treatment is carried out inside the roller cover, it is possible to absorb dew-condensed liquid and prevent the dew-condensed liquid from sticking from the roller cover to the measuring roller, and therefore, coating unevenness can be prevented.

According to still another aspect of the invention, a liquid reservoir section may be provided at a periphery of the roller cover.

According to the coating apparatus related to the aspect of the invention, since the liquid reservoir section is provided at the periphery of the roller cover, liquid condensed into dew and stuck to the roller cover can be collected in the liquid reservoir section, and therefore, it is possible to prevent the liquid from sticking from the roller cover to the measuring roller, and thus coating unevenness can be prevented.

According to still another aspect of the invention, a distance between the measuring blade and a contact point between the measuring roller and the coating roller may be in a range of 1/5 to 1/3 of a circumference of the measuring roller.

According to the coating apparatus related to the aspect of the invention, since the distance between the measuring blade and the contact point between the measuring roller and the coating roller is set to be in the above range, scraping of the measuring blade and prevention of evaporation on the measuring roller can be effectively performed.

In order to achieve the object, according to still another aspect of the invention, there is provided an inkjet recording apparatus including: the coating apparatus according to the aspects described above; and an inkjet head configured to record an image by discharging ink onto a recording medium to which coating liquid is applied by the coating apparatus.

According to the aspect of the invention, since it is possible to stably apply the coating liquid to the recording medium, a high-quality image can be formed on the recording medium.

According to the coating apparatus related to the aspect of the invention, since the roller cover is provided on the measuring roller and the measuring roller and the cover are integrally moved at the time of separation of the measuring roller from the coating roller, it is possible to prevent evaporation of the coating liquid from the coating liquid pan. That is, since the measuring roller and the cover are integrally moved, whereby an opening portion formed between the measuring roller and the cover does not widen, it is possible to prevent evaporation of the coating liquid through the opening portion. Further, since the measuring roller and the roller cover are moved in a state where the coating liquid pan is fixed, the liquid surface of the coating liquid in the coating liquid pan can be stabilized. Therefore, since it is possible to prevent evaporation of the coating liquid, it is not necessary to provide a concentration meter or a dilution function in the coating apparatus, and thus the cost can be reduced.

DESCRIPTION OF THE PREFERRED EMBODIMENTS

Hereinafter, a preferred embodiment of a coating apparatus according to the invention will be described according to the accompanying drawings.

<Overall Configuration of Inkjet Recording Apparatus>

Figure 1:
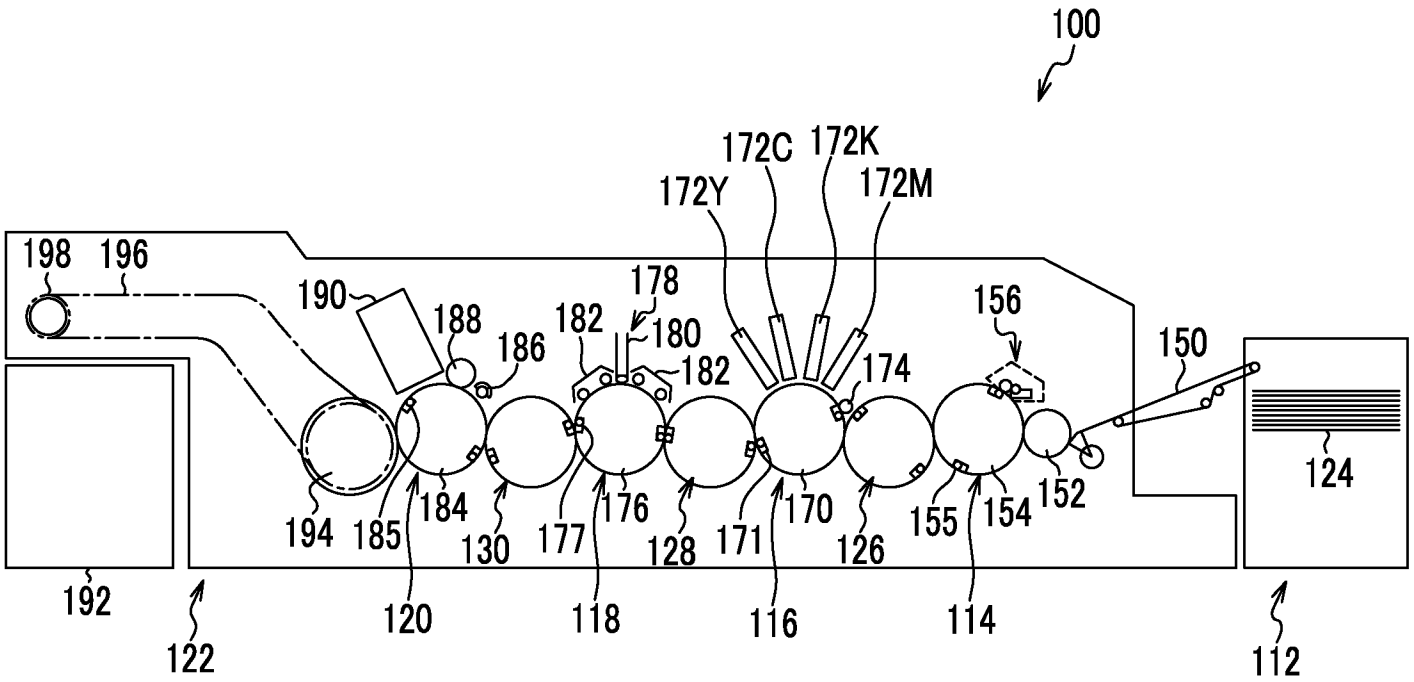
FIG. 1 is a configuration diagram schematically showing an inkjet recording apparatus with a coating apparatus according to an embodiment of the invention applied thereto.

FIG. 1 is a configuration diagram showing the overall configuration of an inkjet recording apparatus in which a coating apparatus according to the invention is used.

An inkjet recording apparatus 100 is a pressure cylinder direct drawing type inkjet recording apparatus which forms a desired color image by dropping ink of plural colors from inkjet heads 172M, 172K, 172C, and 172Y onto a recording medium 124 (sometimes referred to as "paper" for convenience) retained on a pressure cylinder (a drawing drum 170) of a drawing section 116. Further, the inkjet recording apparatus 100 is an on-demand type image forming apparatus to which a two-liquid reaction (aggregation) method is applied, which performs image formation on the recording medium 124 by applying treatment liquid (here, aggregation treatment liquid) as coating liquid onto the recording medium 124 before ink dropping and making the treatment liquid react with ink liquid.

As shown in the drawing, the inkjet recording apparatus 100 mainly includes a paper feed section 112, a treatment liquid application section 114, the drawing section 116, a drying section 118, a fixing section 120, and a discharge section 122.

(Paper Feed Section)

The paper feed section 112 is a mechanism to supply the recording medium 124 to the treatment liquid application section 114 and the recording media 124 that are sheets are stacked in the paper feed section 112. A paper feed tray 150 is provided in the paper feed section 112 and the recording media 124 are fed one by one from the paper feed tray 150 to the treatment liquid application section 114.

In the inkjet recording apparatus 100 of this example, as the recording medium 124, plural types of recording media 124 having different paper types or sizes (paper sizes) may be used. A plurality of paper trays (not shown) in which various recording media are respectively separated and accumulated may be provided in the paper feed section 112, an aspect to automatically switch paper which is sent to the paper feed tray 150 in the plurality of paper trays is also possible, and an aspect in which an operator selects or replaces the paper tray, as necessary, is also possible. In addition, in this example, as the recording medium 124, a sheet (cut paper) is used. However, a configuration to feed paper cut from continuous paper (rolled paper) to a required size is also possible.

(Treatment Liquid Application Section)

The treatment liquid application section 114 is a mechanism to apply the treatment liquid onto the recording surface of the recording medium 124. The treatment liquid contains a coloring material aggregating agent which aggregates coloring materials (in this example, pigments) in ink that is imparted in the drawing section 116, and the treatment liquid and the ink come into contact with each other, whereby the separation of the coloring material and a solvent from the ink is promoted.

As shown in FIG. 1, the treatment liquid application section 114 includes a paper feed cylinder 152, a treatment liquid drum 154, and a coating apparatus 156. The treatment liquid drum 154 is a drum which retains and rotationally transports the recording medium 124. The treatment liquid drum 154 has claw-shaped retaining means (a gripper) 155 on the outer peripheral surface thereof and is made so as to be able to retain a leading end of the recording medium 124 by inserting the recording medium 124 between a claw of the retaining means 155 and the circumferential surface of the treatment liquid drum 154. The treatment liquid drum 154 may have suction holes provided in the outer peripheral surface thereof and be connected to suction means for performing suction from the suction holes. In this way, the recording medium 124 can be retained in close contact with the circumferential surface of the treatment liquid drum 154.

The coating apparatus 156 is provided outside the treatment liquid drum 154 so as to face the circumferential surface of the treatment liquid drum 154. The coating apparatus 156 is configured to include a coating liquid pan with the treatment liquid stored therein, an anilox roller (a measuring roller) partially immersed in the treatment liquid of the coating liquid pan, and a rubber roller (a coating roller) which comes into pressure contact with the anilox roller and the recording medium 124 on the treatment liquid drum 154 and transfers the treatment liquid after measurement to the recording medium 124. According to the coating apparatus 156, it is possible to apply the treatment liquid onto the recording medium 124 while measuring the treatment liquid.

The recording medium 124 with the treatment liquid applied thereto in the treatment liquid application section 114 is transferred from the treatment liquid drum 154 through an intermediate transport section 126 to the drawing drum 170 of the drawing section 116.

(Drawing Section)

The drawing section 116 includes the drawing drum (a second transport body) 170, a paper pressing roller 174, and the inkjet heads 172M, 172K, 172C, and 172Y. The drawing drum 170 has claw-shaped retaining means (a gripper) 171 on the outer peripheral surface thereof, similar to the treatment liquid drum 154. The recording medium 124 fixed to the drawing drum 170 is transported to be disposed such that the recording surface faces the outside, and ink is applied from the inkjet heads 172M, 172K, 172C, and 172Y to the recording surface.

It is preferable that each of the inkjet heads 172M, 172K, 172C, and 172Y be a full line type inkjet recording head (an inkjet head) having a length corresponding to the maximum width of an image formation area in the recording medium 124. A nozzle row in which a plurality of nozzles for ink discharge is arranged over the entire width of the image formation area is formed in an ink discharge surface. Each of the inkjet heads 172M, 172K, 172C, and 172Y is installed so as to extend in a direction perpendicular to a transport direction of the recording medium 124 (a rotation direction of the drawing drum 170).

Droplets of corresponding color ink are discharged toward the recording surface of the recording medium 124 retained in close contact with the drawing drum 170 from each of the inkjet heads 172M, 172K, 172C, and 172Y, whereby the ink comes into contact with the treatment liquid applied to the recording surface in advance in the treatment liquid application section 114, and thus the coloring materials (the pigments) dispersed in the ink are aggregated and a coloring material aggregate is formed. In this way, coloring material flow or the like on the recording medium 124 is prevented and an image is formed on the recording surface of the recording medium 124.

In addition, in this example, the configuration of using standard colors (four colors) that are cyan (C), magenta (M), yellow (Y), and black (K) is illustrated. However, ink colors or the combination of the number of colors is not limited to this embodiment and light ink, dark ink, or special color ink may be added, as necessary. For example, a configuration is also possible in which an inkjet head that discharges light-type ink such as light cyan or light magenta may be added, and a disposition order of the heads of the respective colors is also not particularly limited.

The recording medium 124 with an image formed thereon in the drawing section 116 is transferred from the drawing drum 170 through an intermediate transport section 128 to a drying drum 176 of the drying section 118.

(Drying Section)

The drying section 118 is a mechanism to dry the moisture contained in the solvent separated by coloring material aggregation action and includes the drying drum 176 and a solvent drying device 178, as shown in FIG. 1.

The drying drum 176 has claw-shaped retaining means (a gripper) 177 on the outer peripheral surface thereof, similar to the treatment liquid drum 154, and is made so as to be able to retain the leading end of the recording medium 124 by the retaining means 177.

The solvent drying device 178 is disposed at a position facing the outer peripheral surface of the drying drum 176 and configured to include a plurality of IR heaters 182 and warm air blowing-out nozzles 180 respectively disposed between the respective IR heaters 182.

Various drying conditions can be realized by appropriately regulating the temperature and the air volume of warm air which is blown toward the recording medium 124 from each warm air blowing-out nozzle 180, and the temperature of each of the IR heaters 182.

Further, the surface temperature of the drying drum 176 is set to be greater than or equal to 50° C. By performing heating from the back of the recording medium 124, drying is promoted and image breakdown at the time of fixing can be prevented. In addition, the upper limit of the surface temperature of the drying drum 176 is not particularly limited. However, from the viewpoint of safety (prevention of burns due to high temperature) of maintenance work such as cleaning of ink stuck to the surface of the drying drum 176, it is preferable that the surface temperature of the drying drum 176 be set to less than or equal to 75° C. (more preferably, less than or equal to 60° C.).

By retaining the recording medium 124 on the outer peripheral surface of the drying drum 176 such that the recording surface of the recording medium 124 faces the outside (that is, in a state where the recording medium 124 is curved such that the recording surface of the recording medium 124 becomes a convex side) and performing drying while rotationally transporting the recording medium 124, it is possible to prevent occurrence of wrinkles or floating of the recording medium 124 and it is possible to reliably prevent drying unevenness due to these.

The recording medium 124 with drying treatment performed thereon in the drying section 118 is transferred from the drying drum 176 through an intermediate transport section 130 to a fixing drum 184 of the fixing section 120.

(Fixing Section)

The fixing section 120 is configured to include the fixing drum 184, a halogen heater 186, a fixing roller 188, and an inline sensor 190. The fixing drum 184 has claw-shaped retaining means (a gripper) 185 on the outer peripheral surface thereof, similar to the treatment liquid drum 154, and is made so as to be able to retain the leading end of the recording medium 124 by the retaining means 185.

By the rotation of the fixing drum 184, the recording medium 124 is transported to be disposed such that the recording surface faces the outside, and preliminary heating by the halogen heater 186, fixing treatment by the fixing roller 188, and inspection by the inline sensor 190 are performed with respect to the recording surface.

The halogen heater 186 is controlled to have a predetermined temperature (for example, 180° C.). In this way, the preliminary heating of the recording medium 124 is performed.

The fixing roller 188 is a roller member for welding self-dispersible thermoplastic resin fine particles in the ink by heating and pressurizing the dried ink, and forming a film of the ink, and is configured so as to heat and pressurize the recording medium 124. Specifically, the fixing roller 188 is disposed so as to come into pressure contact with the fixing drum 184 and made so as to configure a nip between the fixing roller 188 and the fixing drum 184. In this way, the recording medium 124 is sandwiched between the fixing roller 188 and the fixing drum 184 and nipped at predetermined nip pressure (for example, 0.15 MPa), whereby fixing treatment is performed.

Further, the fixing roller 188 is configured by a heating roller in which a halogen lamp is incorporated into a pipe of metal such as aluminum having good thermal conductivity, and is controlled to have a predetermined temperature (for example, in a range of 60° C. to 80° C.). By heating the recording medium 124 by the heating roller, thermal energy greater than or equal to the Tg temperature (glass transition point temperature) of the thermoplastic resin fine particles contained in the ink is applied, whereby the thermoplastic resin fine particles are melted. In this way, push-in fixing is performed on the irregularity of the recording medium 124 and also the irregularity of the surface of an image is leveled, and thus gloss is obtained.

In addition, in the embodiment of FIG. 1, a configuration is adopted in which only one fixing roller 188 is provided. However, a configuration is also acceptable in which the fixing rollers are provided in plural stages according to the thickness of an image layer or the Tg characteristic of the thermoplastic resin fine particles.

On the other hand, the inline sensor 190 is measurement means for measuring a check pattern, the amount of moisture, a surface temperature, glossiness, or the like with respect to an image fixed onto the recording medium 124, and a CCD line sensor or the like is applied.

According to the fixing section 120 configured as described above, since the thermoplastic resin fine particles in a lamellate image layer formed in the drying section 118 are melted by being heated and pressurized by the fixing roller 188, it is possible to tightly fix the image layer to the recording medium 124. Further, by setting the surface temperature of the fixing drum 184 to a temperature greater than or equal to 50° C., drying is promoted by heating the recording medium 124 retained on the outer peripheral surface of the fixing drum 184 from the back, and thus it is possible to prevent image breakdown at the time of fixing and also it is possible to increase image intensity by the temperature rising effect of image temperature.

Further, in a case where a UV curable monomer is contained in ink, by radiating UV on an image in a fixing section provided with a UV radiation lamp after moisture is sufficiently volatilized in the drying section, the UV curable monomers are cured and polymerized and image intensity can be improved.

(Discharge Section)

As shown in FIG. 1, the discharge section 122 is provided following the fixing section 120. The discharge section 122 includes a discharge tray 192, and a delivery cylinder 194, a transport belt 196, and a tension roller 198 are provided between the discharge tray 192 and the fixing drum 184 of the fixing section 120 so as to face the discharge tray 192 and the fixing drum 184. The recording medium 124 is sent to the transport belt 196 by the delivery cylinder 194 and discharged to the discharge tray 192.

Further, although not shown in the drawing, the inkjet recording apparatus 100 of this example further includes an ink storage and loading section which supplies ink to each of the inkjet heads 172M, 172K, 172C, and 172Y, and means for supplying the treatment liquid to the treatment liquid application section 114, in addition to the above configuration, and is also provided with a head maintenance section which performs cleaning (wiping of a nozzle surface, purging, nozzle suction, or the like) of each of the inkjet heads 172M, 172K, 172C, and 172Y, a position detection sensor which detects the position of the recording medium 124 on a paper transport path, a temperature sensor which detects the temperature of each section of the apparatus, or the like.

<Configuration of Coating Apparatus>

Next, the coating apparatus configured to apply the treatment liquid to the recording medium will be described.

Figure 2:
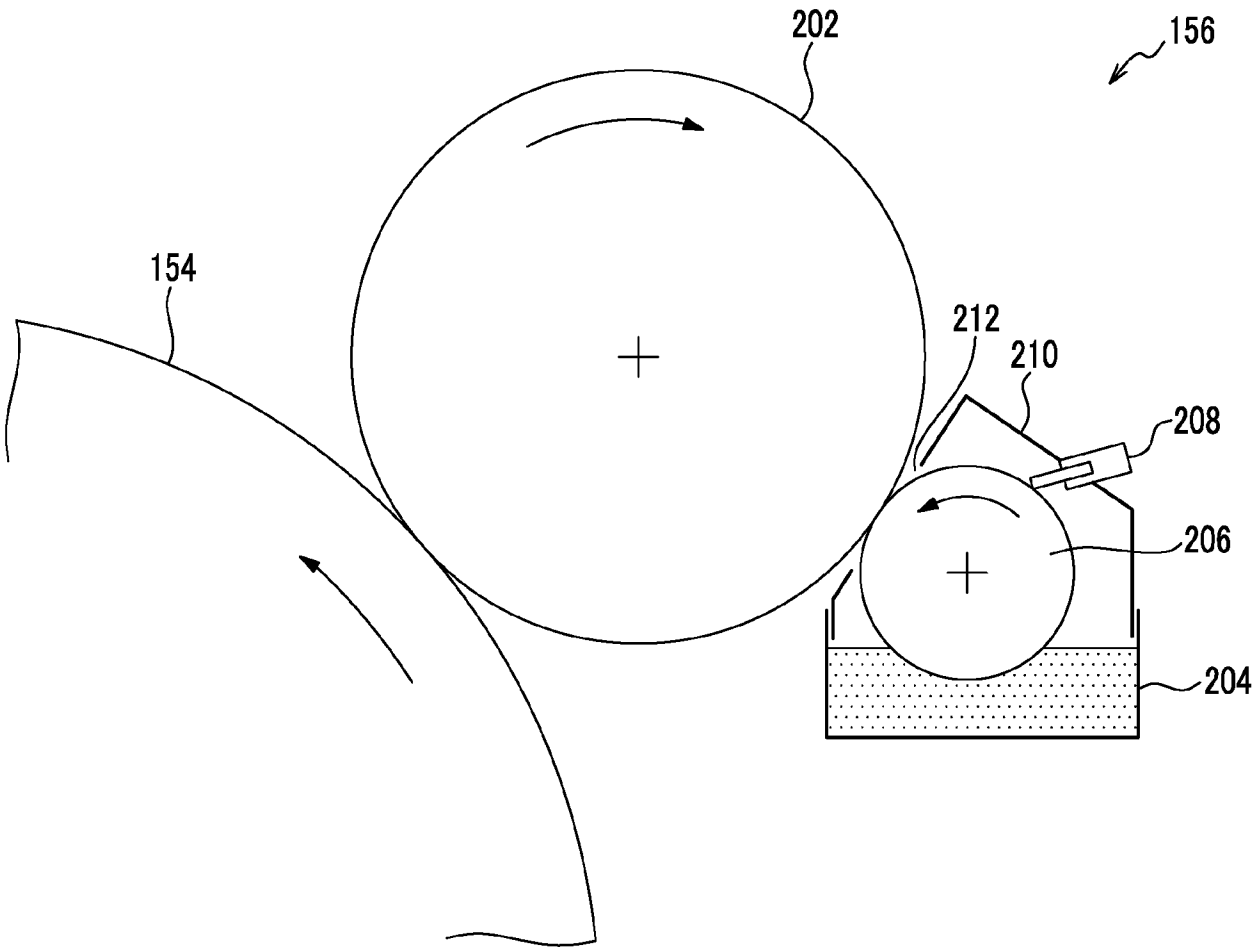
FIG. 2 is a diagram showing the schematic configuration of the coating apparatus.
Figure 3:
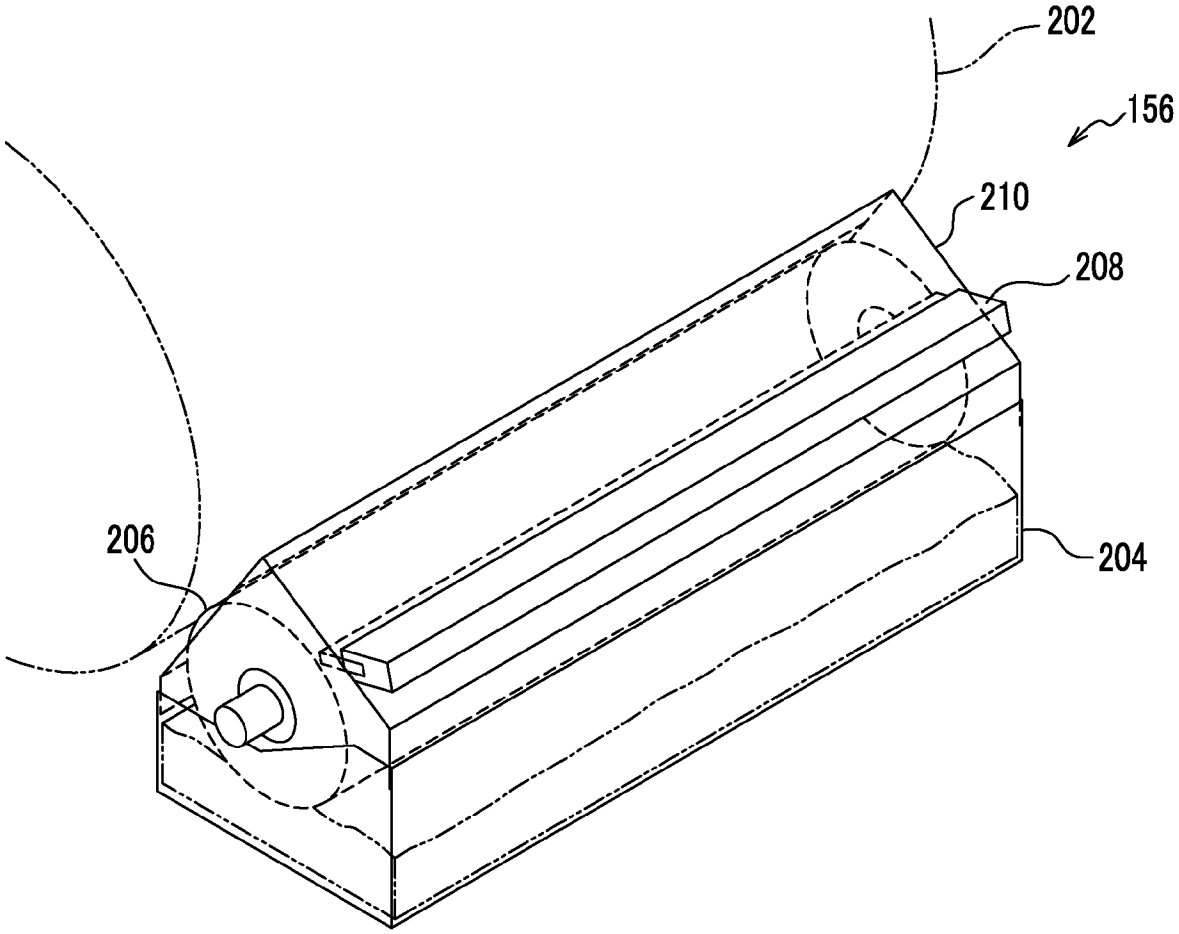
FIG. 3 is a perspective view showing the schematic configuration of the coating apparatus.

FIG. 2 is an overall configuration diagram showing the schematic configuration of the coating apparatus 156 and FIG. 3 is a perspective view showing the schematic configuration of the coating apparatus 156.

The coating apparatus 156 shown in FIG. 2 includes the treatment liquid drum (a pressure cylinder) 154, a coating roller 202, a coating liquid pan 204, a measuring roller 206, a measuring blade 208, and a roller cover 210. The treatment liquid drum (the pressure cylinder) 154 retains the recording medium on the circumferential surface thereof. The coating roller comes into contact with the recording medium retained on the treatment liquid drum (the pressure cylinder) 154 and applies the treatment liquid to the recording medium. The treatment liquid is filled in the coating liquid pan 204. The measuring roller 206 draws up the treatment liquid from the coating liquid pan 204 and supplies the treatment liquid to the coating roller 202. The measuring blade 208 adjusts the treatment liquid drawn up from the measuring roller 206 to a predetermined amount. The roller cover 210 covers the coating liquid pan 204 and the measuring roller 206.

Although a configuration is adopted in this embodiment in which a single coating roller is provided, another configuration may be adopted, in which a plurality of coating rollers is provided. For example, a configuration may be adopted, in which an additional coating roller (an intermediate roller) is provided between the coating roller 202 and the measuring roller 206.

The treatment liquid drum (the pressure cylinder) 154 is means for retaining the recording medium on the circumferential surface thereof and transporting the recording medium and has a cylindrical drum shape. The recording medium retained on the circumferential surface of the treatment liquid drum (the pressure cylinder) 154 is moved along the rotation direction of the treatment liquid drum (the pressure cylinder) 154 by rotating the treatment liquid drum (the pressure cylinder) 154 in the shown counterclockwise direction by a rotation mechanism (not shown).

The coating roller 202 has a surface configured of a material (for example, rubber) capable of retaining a predetermined amount of treatment liquid and is configured so as to be able to be rotationally driven in the opposite direction (a clockwise direction) to the treatment liquid drum (the pressure cylinder) 154 by a rotation mechanism (not shown). The treatment liquid is applied to the surface of the recording medium by pressing the coating roller 202 against the recording medium retained on the treatment liquid drum (the pressure cylinder) 154 at a predetermined pressing force while rotating the coating roller 202 at a predetermined rotating speed.

As for the measuring roller 206, an anilox roller with fine grooves (cells) (not shown) formed in the surface thereof is applied. A portion of the surface of the measuring roller 206 is immersed in the treatment liquid in the coating liquid pan 204 and the measuring roller 206 is rotated in the counterclockwise direction opposite to the coating roller 202, thereby drawing up the treatment liquid retained in the coating liquid pan 204. If the surface of the measuring roller 206 comes into contact with the surface of the coating roller 202, the treatment liquid retained in the grooves of the measuring roller 206 is transferred to the surface of the coating roller 202. In a case where application of the treatment liquid is not performed, the measuring roller 206 is separated from the coating roller 202, thereby stopping supply of the treatment liquid to the coating roller 202.

The coating liquid pan 204 is a member in which the treatment liquid supplied from a supply flow path is stored inside. The treatment liquid in the coating liquid pan 204 is drawn up to the measuring roller 206, as described above, and transferred to the coating roller 202, and applied to the recording medium.

The measuring blade 208 is a member which regulates the treatment liquid drawn up by the measuring roller 206 to a predetermined amount. A predetermined treatment liquid amount is the amount of treatment liquid which is applied to the recording medium. The amount of treatment liquid is adjusted by scraping away the treatment liquid drawn up by the measuring roller 206 by the measuring blade 208.

Figure 4:
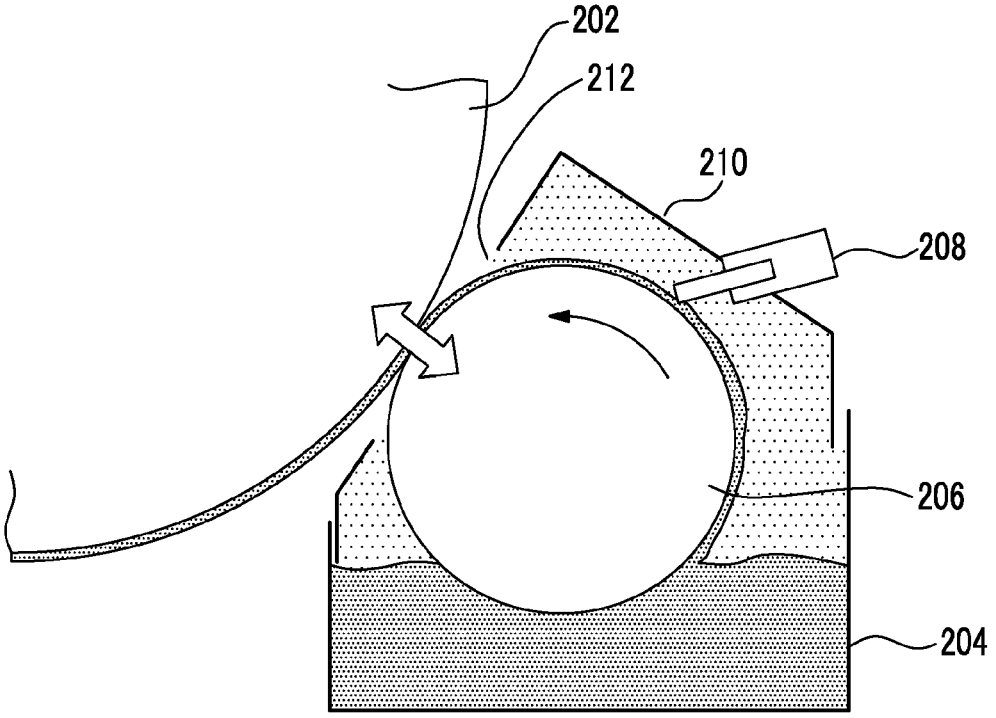
FIG. 4 is a diagram describing a separation operation of the coating apparatus and a diagram showing a coating state.
Figure 5:
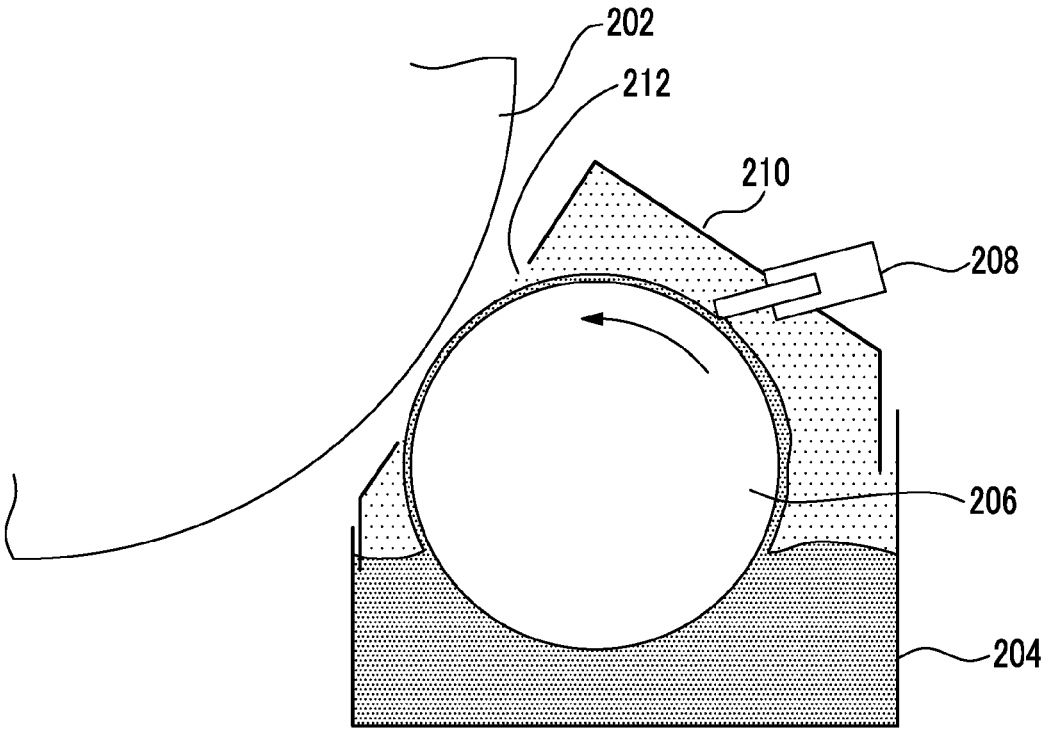
FIG. 5 is a diagram describing the separation operation of the coating apparatus and a diagram showing a coating stop state.

In this embodiment, the coating apparatus 156 has the roller cover 210 which covers the measuring roller 206 and the coating liquid pan 204. Further, in order to bring the measuring roller 206 into contact with the coating roller 202 and apply the treatment liquid to the coating roller 202, the roller cover 210 has an opening portion 212 for bringing the measuring roller 206 into contact with the coating roller 202. FIG. 4 is a diagram showing a state where the measuring roller 206 is brought into contact with the coating roller 202, and FIG. 5 is a diagram showing a state where the measuring roller 206 is separated from the coating roller 202. As shown in FIGS. 4 and 5, the roller cover 210 is movable separately from the coating liquid pan 204. The roller cover 210 is moved in a direction of an arrow in the drawings in accordance with a contact operation of the measuring roller 206 with the coating roller 202 and a separation operation of the measuring roller 206 from the coating roller 202. Further, the measuring blade 208 is also moved in accordance with the movement of the roller cover 210 and the measuring roller 206.

In order to integrally operate the measuring roller 206, the roller cover 210, and the measuring blade 208 separately from the coating liquid pan 204, as shown in FIG. 4, an opening of the coating liquid pan 204 is designed larger than the roller cover 210 and the roller cover 210 is moved in the coating liquid pan 204. With respect to the moving directions of the measuring roller 206 and the roller cover 210, a space may be provided between the opening portion of the roller cover 210 and the opening portion of the coating liquid pan 204 in a range in which the movement of the roller cover 210 is possible. Such configuration in which the roller cover 210 is accommodated in the opening portion of the coating liquid pan 204 makes it possible to collect liquid condensed on the inner surface of the roller cover 210 in the coating liquid pan 204 along the inner surface of the roller cover 210, Thus, such configuration makes it possible to suppress a change in the concentration of the treatment liquid in the coating liquid pan 204.

In order to integrally move the measuring roller 206, the roller cover 210, and the measuring blade 208, the coating apparatus 156 is provided with moving devices configured to move the respective members. The measuring roller 206, the roller cover 210 and the measuring blade 208 are integrally moved by operating each moving device. The moving device includes, for example, a pair of measuring roller support arm members (not shown) provided at a main body frame (not shown) of the coating apparatus 156, and an actuating device (not shown) for actuating the measuring roller support arm member. By providing the measuring roller support arm as being capable of rotating, sliding, or arbitrarily moving around a rotation axis of the measuring roller 206 and by actuating the measuring roller support arm by the actuating device (for example, a mechanical sliding member, a cylinder, or the like), the measuring roller 206 is moved with respect to the coating roller 202. Further, also as to the roller cover 210 and the measuring blade 208, in a similar manner to the measuring roller 206, the moving device may be configured by a support arm and an actuating device for actuating the support arm. Furthermore, it is also possible to integrally form the respective members and move the members by a single moving device.

In FIGS. 4 and 5, the moving directions of the measuring roller 206, the roller cover 210, and the measuring blade 208 are set in an oblique direction in the drawings. However, the movement direction is not limited thereto, and the measuring roller 206, the roller cover 210 and the measuring blade 208 may be moved, for example, in a left-and-right direction in the drawings.

It is preferable that the distance between a contact point between the measuring roller 206 and the coating roller 202 and the measuring blade 208 be set to be in a range of ⅕ to ⅓ of the circumference of the measuring roller 206. By setting the distance between the contact point and the measuring blade 208 to be in the above range, it is possible to stably perform supply of the treatment liquid to the coating roller 202. This is because if the above distance is short, the treatment liquid is supplied to the coating roller 202 before the treatment liquid on the measuring roller 206 regulated by the measuring blade 208 is stabilized and if the above distance is long, there is a possibility that the treatment liquid may evaporate before the treatment liquid is supplied to the coating roller 202.

Further, a configuration is also possible in which the measuring blade 208 is formed integrally with the roller cover 210, and thus the measuring blade 208 also serves as the roller cover 210. By integrally forming the measuring blade 208 and the roller cover 210, it is possible to suppress a variation in the contact force of the measuring blade 208 with respect to the measuring roller 206 when operating the measuring roller 206, the measuring blade 208, and the roller cover 210. Therefore, since it is possible to stabilize the amount of treatment liquid which is adjusted by the measuring blade 208, coating unevenness can be prevented.

Figure 6B:
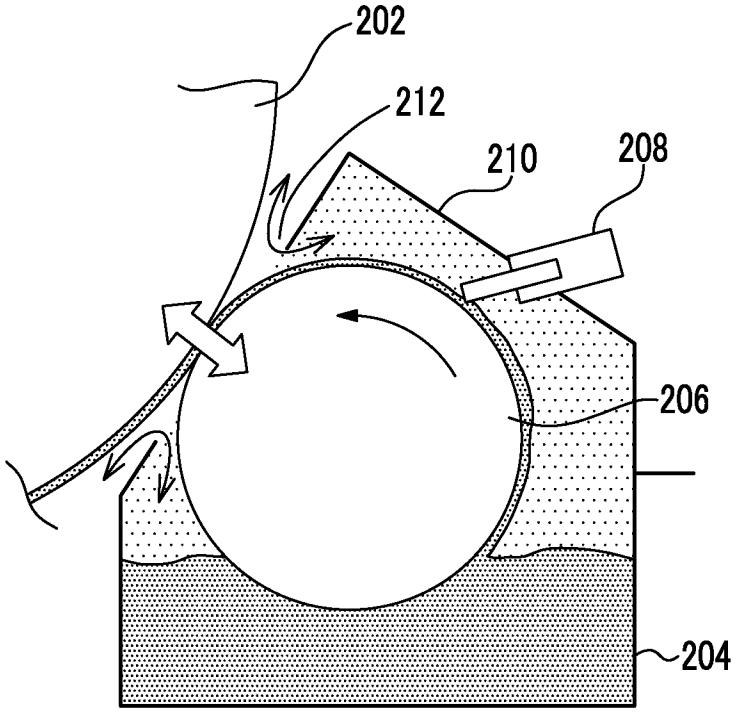
FIGS. 6A and 6B are diagrams describing a problem of a coating apparatus of the related art.
Figure 6A:
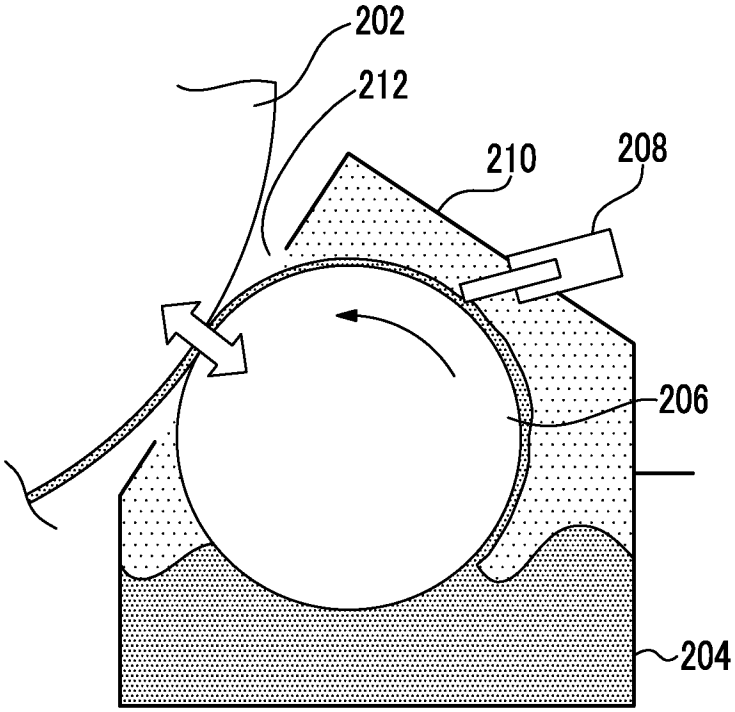

FIGS. 6A and 6B are diagrams describing a problem in the related art. FIG. 6A shows a case where the entire coating apparatus 156 is separated from the coating roller 202 at the time of a separation operation of the measuring roller 206 from the coating roller 202. In FIG. 6A, since the entire coating apparatus 156 is separated in a unified manner, the liquid surface of the treatment liquid in the coating liquid pan 204 is not stabilized due to the movement of the coating liquid pan 204, and the treatment liquid is stuck to the measuring roller 206. Thus, in such a case as shown in FIG. 6A, it is not possible to perform the stable application of treatment liquid.

Further, FIG. 6B shows a case where only the measuring roller 206 is moved at the time of a separation operation of the measuring roller 206 from the coating roller 202. In such case where only the measuring roller 206 is moved, clearance between the measuring roller 206 and the opening portion 212 of the roller cover 210 becomes wide and also vapor of the treatment liquid in the roller cover 210 is likely to be replaced with external air due to the movement of the measuring roller 206. In addition, in the measuring roller 206 further toward the downstream side in the rotation direction from the measuring blade 208, since the amount of treatment liquid which is retained by the measuring roller 206 has been adjusted to an amount to be applied to the recording medium, the amount of treatment liquid is small, and thus the treatment liquid is likely to be dried.

On the other hand, in this embodiment, as shown in FIG. 4, since the measuring roller 206, the measuring blade 208, and the roller cover 210 are operated in a unified manner, whereby it is not necessary to move the coating liquid pan 204, the liquid surface of the treatment liquid in the coating liquid pan 204 is stabilized. Therefore, since it is possible to prevent liquid splashing of the treatment liquid in the coating liquid pan 204 and also prevent the supply amount of the treatment liquid to the measuring roller from becoming insufficient, it is possible to sufficiently perform the supply of the treatment liquid to the measuring roller 206. Further, it is possible to carry out application of the treatment liquid with high precision.

Further, in this embodiment, the measuring roller 206 is moved while the positional relationship between the roller cover 210 and the measuring roller 206 in the opening portion 212 is maintained. Therefore, since the clearance between the roller cover 210 and the measuring roller 206 in the opening portion 212 does not change, inflow of external air from the opening portion 212 into the roller cover 210 is reduced, and thus the inside of the roller cover 210 is made to be filled with vapor in which the treatment liquid is saturated. By stabilizing vapor in the roller cover 210, it is possible to prevent evaporation of the treatment liquid applied to the surface of the measuring roller 206. Therefore, it is possible to maintain a constant concentration of the treatment liquid. In this manner, in this embodiment, in order to prevent vapor in the roller cover 210 from being replaced with external air, it is preferable that the clearance between the measuring roller 206 and the roller cover 210 in the opening portion 212 be small and that an area from the measuring blade to the contact point between the measuring roller and the coating roller, in which the treatment liquid on the measuring roller 206 is measured to be reduced, be driven integrally with the roller cover 210.

In this embodiment, in particular, the surface of the measuring roller 206 from the measuring blade 208 to a contact position with the coating roller 202 on the downstream side in the rotation direction of the measuring roller 206 is covered by the roller cover 210. Since the treatment liquid scraped away by the measuring blade 208 has been adjusted to an amount which is applied to the recording medium, the thickness of the treatment liquid on the measuring roller 206 becomes thin, and therefore, especially, the treatment liquid is more likely to dry. According to this embodiment, since it is possible to prevent drying of the treatment liquid on the measuring roller 206 after the measurement in the measuring blade 208, it is possible to prevent concentration of the treatment liquid.

In addition, the roller cover 210 may have a heat-insulated structure. By making the roller cover 210 have a heat-insulated structure, it is possible to prevent dew condensation on the inner surface of the roller cover 210, and thus it is possible to prevent occurrence of unevenness in the application of the treatment liquid due to sticking of dew-condensed liquid to the measuring roller 206. The heat-insulated structure may be obtained by carrying out raising treatment (i.e., napping) on the inner surface of the roller cover, using a heat insulating material as a material of the roller cover, or the like.

Figure 7:
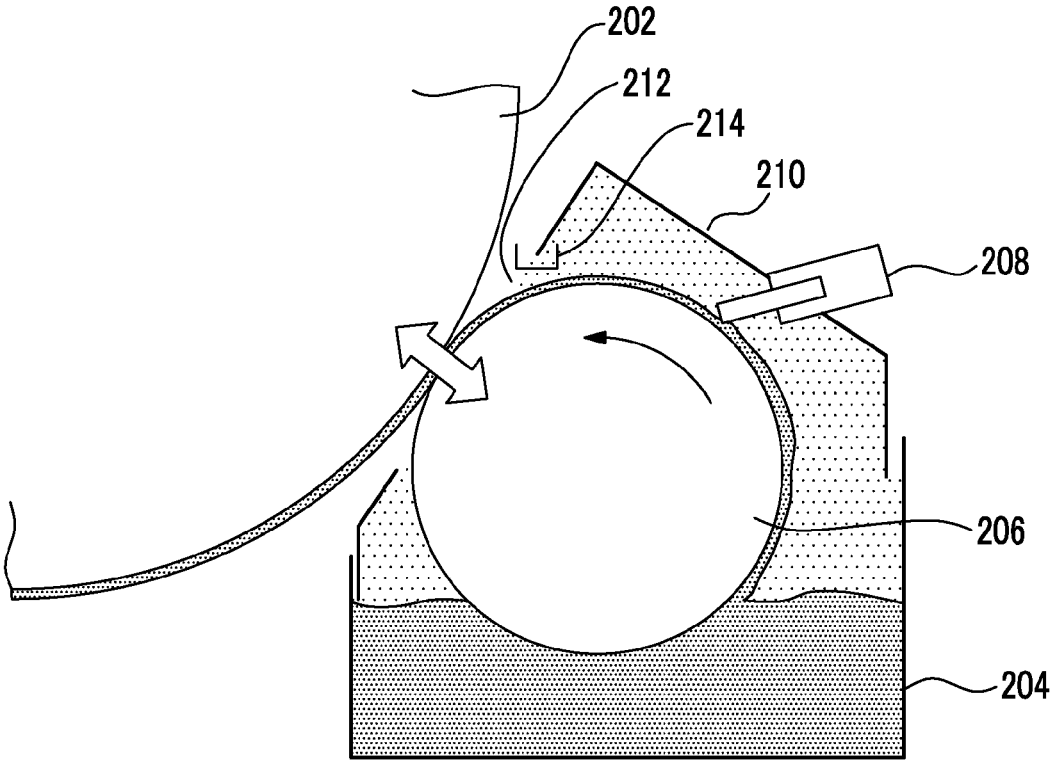
FIG. 7 is a diagram showing a coating apparatus according to another embodiment of the invention.

Further, as shown in FIG. 7, a liquid reservoir section 214 configured to return the liquid generated in the roller cover 210 due to dew condensation back to the coating liquid pan 204 may be provided at the roller cover 210. By providing the liquid reservoir section 214, it is possible to collect liquid generated due to dew condensation in the roller cover 210 in the liquid reservoir section 214, and therefore, it is possible to prevent the dew-condensed liquid from dripping to the measuring roller 206, thereby causing coating unevenness. As the liquid reservoir section, a configuration may be adopted, in which a gutter is provided at an end portion of the roller cover 210 and liquid is collected in the gutter and returned from the gutter to the coating liquid pan 204, such that the dew-condensed liquid does not drip to the measuring roller 206.

Figure 8:
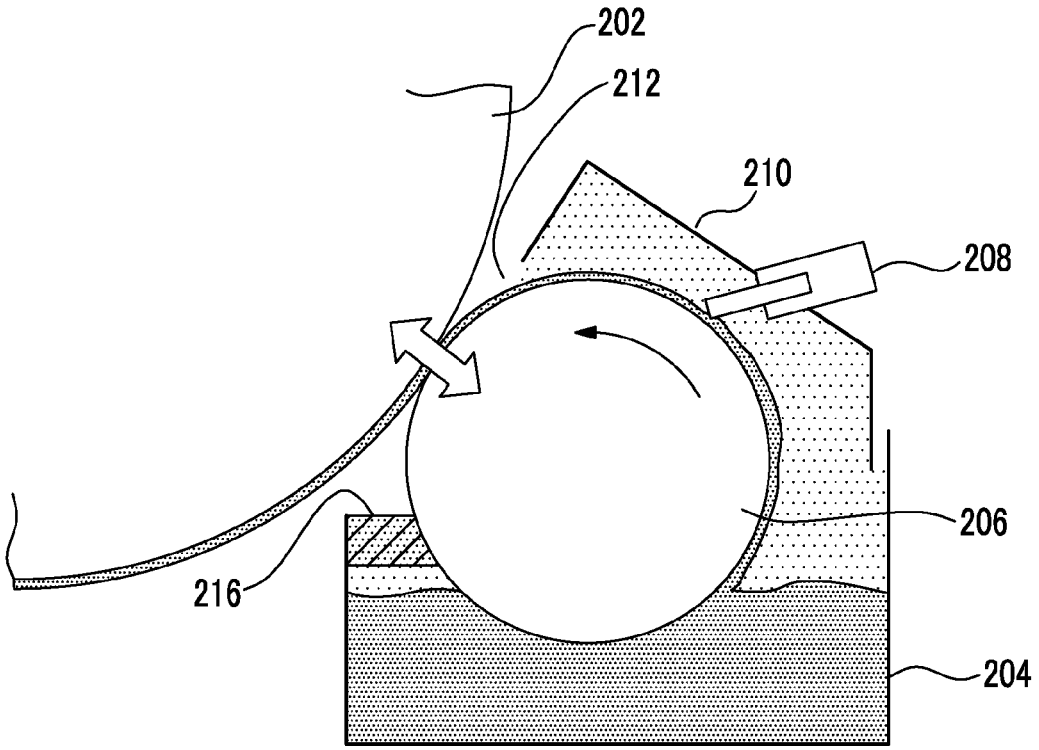
FIG. 8 is a diagram showing an embodiment of a connection portion between a roller cover and a coating liquid pan.
Figure 9:
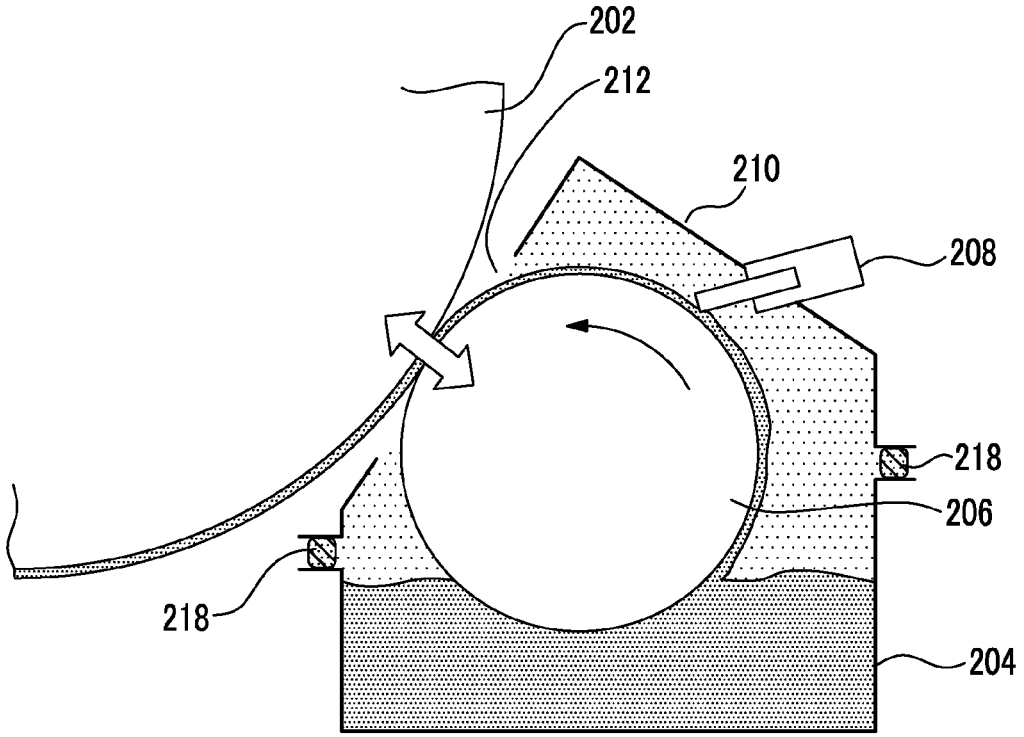
FIG. 9 is a diagram showing another embodiment of a connection portion between a roller cover and a coating liquid pan.

FIGS. 8 and 9 are diagrams showing different embodiments of a connection portion between the coating liquid pan 204 and the roller cover 210. In FIG. 8, by bringing the coating liquid pan 204 and the downstream side in the rotation direction of the measuring roller 206 into contact with each other through a seal member 216, it is possible to prevent evaporation of the treatment liquid. In addition, even in the case where a connection portion between the downstream side in the rotation direction of the measuring roller 206 and the coating liquid pan 204 is made of the seal member 216, since the measuring roller 206 supplies the treatment liquid to the coating roller by being brought into contact with the coating roller 202, the treatment liquid does not remain on the measuring roller 206 after the contact with the coating roller 202. Therefore, it is possible to carry out the application of the treatment liquid without a problem in particular.

In addition, as another embodiment, as shown in FIG. 9, it is also possible to connect the coating liquid pan 204 and the roller cover 210 through a seal member 218. Such connection through the seal member 218 makes it possible to more hermetically seal a space formed by the coating liquid pan 204 and the roller cover, and therefore, evaporation of the treatment liquid can be prevented. As for the seal member, by performing sealing by a stretchable member such as an accordion-shaped member or the like, the movement of the roller cover 210 is possible and sealability can also be increased, and therefore, the saturated vapor in the roller cover 210 is likely to be maintained and it is possible to prevent evaporation of the treatment liquid in the coating liquid pan 204.

What is claimed is:

1. An inkjet recording apparatus comprising:

a coating apparatus including:

a coating roller configured to apply coating liquid to a recording medium;

a measuring roller configured to intermittently supply the coating liquid to the coating roller by being brought into contact with and being separated from the coating roller;

a coating liquid pan configured to store the coating liquid; and a roller cover which covers the measuring roller along an entire length direction of the measuring roller and the coating liquid pan and which has an opening portion for bringing the measuring roller into contact with the coating roller, wherein when the measuring roller moves between a contact position where the coating roller and the measuring roller come into contact with each other and a separation position where the coating roller and the measuring roller are separated from each other, the measuring roller and the roller cover integrally operate while maintaining their relative positions, in a state where the coating liquid pan is fixed, and an inkjet head configured to record an image by discharging ink onto the recording medium to which the coating liquid is applied by the coating apparatus.

2. The inkjet recording apparatus according to claim 1, further comprising:

a measuring blade configured to come into contact with the measuring roller along the entire length direction of the measuring roller, thereby scraping away extra coating liquid from the coating liquid drawn up by the measuring roller, wherein the measuring blade operates integrally with the measuring roller and the roller cover.

3. The inkjet recording apparatus according to claim 2, wherein the roller cover covers at least a portion of an area from the measuring blade to a contact point between the coating roller and the measuring roller on a downstream side in a rotation direction of the measuring roller.

4. The inkjet recording apparatus according to claim 1, wherein a first seal member configured to come into contact with the measuring roller is provided on an upstream side in a rotation direction of the measuring roller of the coating liquid pan.

5. The inkjet recording apparatus according to claim 2, wherein a seal member configured to come into contact with the measuring roller is provided on an upstream side in the rotation direction of the measuring roller of the coating liquid pan.

6. The inkjet recording apparatus according to claim 3, wherein a seal member configured to come into contact with the measuring roller is provided on an upstream side in the rotation direction of the measuring roller of the coating liquid pan.

7. The inkjet recording apparatus according to claim 1, wherein the coating liquid pan and the roller cover are connected by a seal member, and the coating liquid pan and the roller cover are in a connected state when the coating roller and the measuring roller move between the contact position and the separation position.

8. The inkjet recording apparatus according to claim 2, wherein the coating liquid pan and the roller cover are connected by a seal member, and the coating liquid pan and the roller cover are in a connected state when the coating roller and the measuring roller move between the contact position and the separation position.

9. The inkjet recording apparatus according to claim 3, wherein the coating liquid pan and the roller cover are connected by a seal member, and the coating liquid pan and the roller cover are in a connected state when the coating roller and the measuring roller move between the contact position and the separation position.

10. The inkjet recording apparatus according to claim 4, wherein the coating liquid pan and the roller cover are connected by a second seal member, and the coating liquid pan and the roller cover are in a connected state when the coating roller and the measuring roller move between the contact position and the separation position.

11. The inkjet recording apparatus according to claim 2, wherein the measuring blade also serves as the roller cover.

12. The inkjet recording apparatus according to claim 1, wherein the roller cover has a heat-insulated structure.

13. The inkjet recording apparatus according to claim 12, wherein the roller cover has an inner surface to which raising treatment is carried out.

14. The inkjet recording apparatus according to claim 1, wherein a liquid reservoir section is provided at a periphery of the roller cover.

15. The inkjet recording apparatus according to claim 2, wherein a distance between the measuring blade and a contact point between the measuring roller and the coating roller is in a range of 1/5 to 1/3 of a circumference of the measuring roller.

* * * * *